US006138931A

United States Patent [19]

Geurts et al.

[11] Patent Number: 6,138,931

[45] Date of Patent: Oct. 31, 2000

[54] APPARATUS AND METHOD FOR GRINDING PARTICULATE MATERIAL

[75] Inventors: Frank L. S. Geurts, Eindhoven, Netherlands; Dawn M. O'Loughlin, Webster, N.Y.

[73] Assignee: Xerox Corporation, Stamford, Conn.

[21] Appl. No.: 09/361,310

[22] Filed: Jul. 27, 1999

[51] Int. Cl.[7] ..... B02C 19/06

[52] U.S. Cl. ..... 241/40

[58] Field of Search ..... 241/5, 39, 40

[56] References Cited

U.S. PATENT DOCUMENTS 5,133,504 7/1992 Smith et al. .

5,562,253 10/1996 Henderson et al. .

FOREIGN PATENT DOCUMENTS

WO 87/01617 3/1987 WIPO .

*Primary Examiner*—Mark Rosenbaum

*Attorney, Agent, or Firm*—Oliff & Berridge

[57] ABSTRACT

An apparatus for grinding particulate material includes a grinding chamber. Fluid sources mounted on the peripheral wall of the grinding chamber generate a stream of fluid directed along the source axis of the fluid source towards the inside of the grinding chamber. Fluid flow guides associated with fluid sources have a first aperture. Guide members associated with fluid sources have a second aperture. Each guide member co-operates with the fluid stream of the associated fluid source and the associated fluid flow guide to draw fluid towards an upstream portion of the fluid stream and to direct fluid away from a downstream portion of the fluid stream. The fluid streams from the fluid sources overlap in an empty zone of the grinding chamber. The particulate material is introduced into the fluid streams, accelerated by the fluid streams and directed towards the empty zone. Thus particles from different streams collide in the empty zone.

17 Claims, 6 Drawing Sheets

FIG. 2
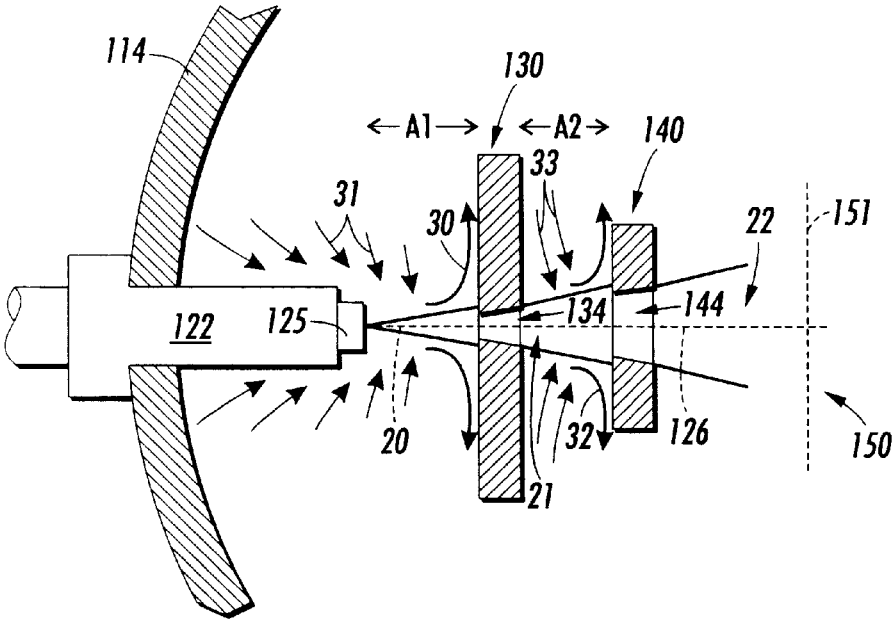
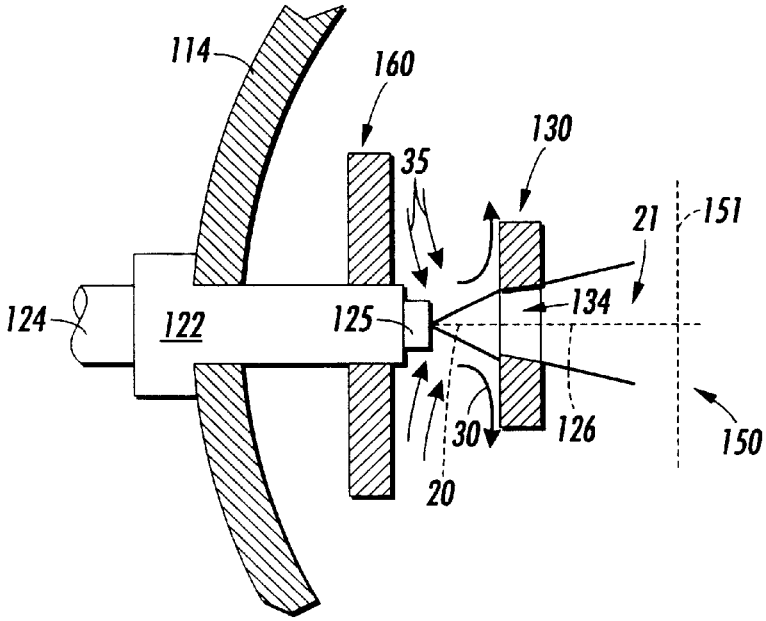
FIG. 3

FIG. 4
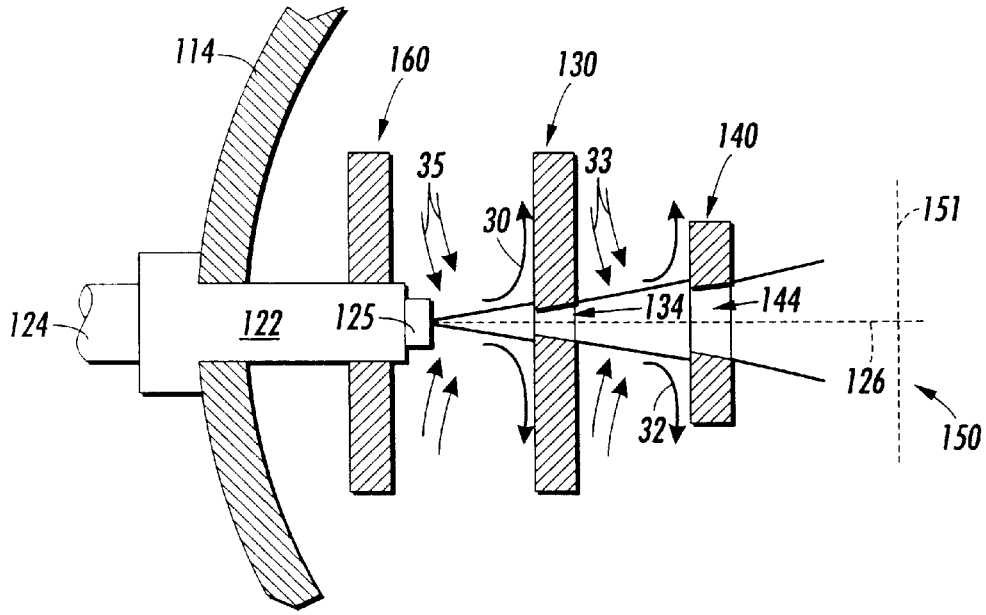
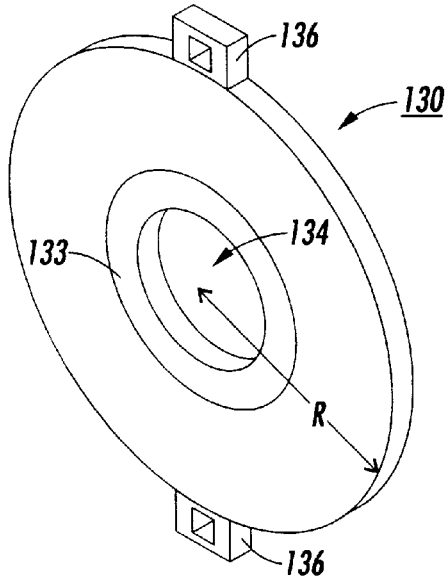
FIG. 5

APPARATUS AND METHOD FOR GRINDING PARTICULATE MATERIAL

BACKGROUND OF THE INVENTION

1. Field of the Invention

This invention relates to an apparatus and a method for grinding particulate material such as toner or the like.

2. Related Art

Particulate material such as toner is generally ground in a fluidized bed jet mill grinder. A fluidized bed jet mill grinder operates by accelerating the particles in the particulate material using jets of air. The particles then impact either on a surface, or other particles, causing them to fragment. By providing fluidized bed jet mill grinder in an enclosed chamber, the particles undergo repeated impact until they are substantially reduced in size. This ground material may then be removed from the grinding chamber.

U.S. Pat. No. 5,133,504 places an impact target at the center of the grinding chamber. The target is configured such that the particles are accelerated toward the target by one of several jets of air, causing the particles to impact on the target surface. While this causes the particles to fragment, resulting in smaller particles, there is generally heavy wear of the target. This in turn causes the target to become less efficient, causing a reduction in the overall efficiency of the grinding chamber. As a result, the impact targets needs to be regularly replaced.

U.S. Pat. No. 5,562,253 discloses an impact target which includes a number of apertures. Each aperture is aligned with a jet of air, such that the jet of air passes through the aperture to the center of the target. Accordingly, any particles caught up in the edge of the jet of air will impact on the target, while any particles in the center of the jet of air will pass through the aperture and impact with other particles from other jets of air in the center of the target. The 253 patent also discloses a flat plate impact target having a single aperture. Each plate is aligned with an associated jet of air. The jet of air again passes through the aperture towards the center of the grinding chamber.

SUMMARY OF THE INVENTION

A fluidized bed jet mill grinder is expensive to operate due to the large amount of energy required to produce sufficient compressed fluid to power the fluid jets. Additionally, the grinding efficiency gained by using aperture targets is highly dependent on the state of the target. That is, as the target wears during grinding, the grinding efficiency can drop significantly.

This invention provides grinding system and methods that have an improved grinding efficiency by changing the fluid dynamics inside the grinder.

This invention additionally provides grinding systems and methods that minimize target wear-related efficiency losses.

This invention separately provides grinding systems and methods that grind particles of a particulate material in an empty zone of a grinding chamber.

In one exemplary embodiment, fluid sources generate streams of fluid directed along a source axis are associated with fluid flow guides having an aperture located on the source axis of the associated fluid source. Guide members co-operate with the associated fluid stream and the associated fluid flow guide to cause fluid to be drawn towards an upstream portion of the fluid stream and to flow away from a downstream portion of the fluid stream, the upstream and downstream portions of the fluid stream being located between the fluid flow guide and the guide member.

In operation, the fluid flow guides and guide members operate to control the flow of fluid in and around the fluid streams. By appropriately positioning the fluid flow guides, the peripheries of the fluid streams and the surrounding fluid is forced tangentially outward from the fluid streams. This causes an region of low pressure to form around each fluid stream, which in turn causes fluid to flow towards that fluid stream.

The associated guide member is positioned to restrict the volume available for this flow of fluid, to increase the velocity of the flow. As a result, particles from the surrounding particulate material are forced into the center of the fluid stream by the flow of fluid. These particles then pass through the aperture of the associated fluid flow guide toward the central axis of the grinding chamber. At this point, the fluid streams from different fluid sources overlap. As a result, particles within the fluid streams collide, causing fragmentation and grinding of the particles.

Various exemplary embodiments of the systems and methods according to this invention ensure particle-to-particle collisions and enhance the concentration of particles within the stream by ensuring that the particles are forced into the center of the fluid stream. This increases the number of particle-to-particle collisions and improves the efficiency of the grinding chamber.

In various exemplary embodiments of the systems and methods according to this invention, each fluid flow guide includes a first aperture plate extending substantially perpendicularly to the associated source axis.

In various exemplary embodiments of the systems and methods according to this invention, each fluid source includes a nozzle extending from the peripheral wall towards the central axis, and each fluid flow guide is positioned between the nozzle of the associated fluid source and the central axis.

In various exemplary embodiments of the systems and methods according to this invention, the aperture of each fluid flow guide diverges away from the source axis in the direction of the fluid stream.

In various exemplary embodiments of the systems and methods according to this invention, each guide member is positioned between the associated fluid flow guide and the central axis. The guide member has an aperture located on the source axis of the associated fluid source.

In various exemplary embodiments of the systems and methods according to this invention, the fluid flow guide and the guide member co-operate to modify the flow of fluid around the fluid stream such that particulate material is forced into the center of the fluid stream. As a result, the particle concentration and the number of particle-to-particle collisions increases. This improves the grinding chamber efficiency.

When each guide member is positioned between the associated fluid flow guide and the central axis, in various exemplary embodiments of the systems and methods according to this invention, each guide member comprises a second aperture plate extending substantially perpendicularly to the source axis. Again, this design suitably modifies the fluid stream and surrounding fluid flow.

In various exemplary embodiments of the systems and methods according to this invention, the apparatus further comprises at least two additional guide members. Each additional guide member can be mounted to the nozzle of an associated fluid source and extending substantially perpendicularly to the source axis. This provides a second region in which a flow of fluid toward the fluid stream is created. This further enhances the efficiency of these exemplary embodiments of the grinding apparatus and methods according to this invention.

These and other features and advantages of this invention are described in or are apparent from the following detailed description of various exemplary embodiments of the systems and methods according to this invention.

BRIEF DESCRIPTION OF THE DRAWINGS

Various exemplary embodiments of this invention will be described in detail, with reference to the following figures, wherein:

FIG. 2 is a schematic diagram representing the flow of fluid around a fluid source and the associated aperture plates of a first exemplary embodiment of the grinding apparatus and methods according to this invention;

FIG. 3 shows the fluid flow around a fluid source and the associated aperture plate of a second exemplary embodiment of the grinding apparatus and methods according to this invention;

FIG. 4 is a schematic diagram showing the flow of fluid around a fluid source and the associated aperture plates of a third exemplary embodiment of the grinding apparatus and methods according to this invention;

FIG. 5 is a perspective view of a first exemplary embodiment of the first and second aperture plates of FIGS. 1 to 4;

DETAILED DESCRIPTION OF THE EXEMPLARY EMBODIMENTS

Figure 1:
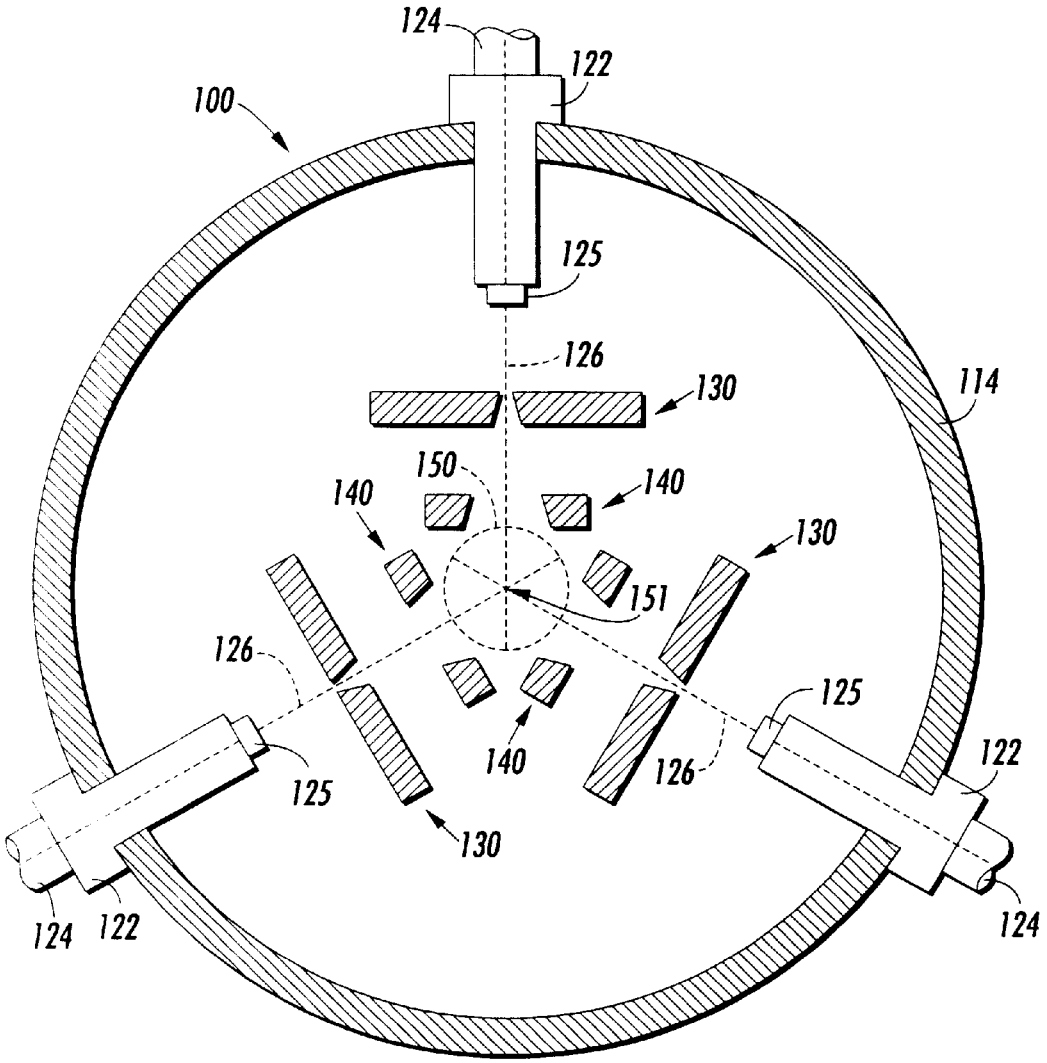
FIG. 1 is a schematic cross-section through a grinding chamber of a fluidized bed jet mill.

FIG. 1 shows a schematic representation of a cross-section through a grinding chamber 100 of a fluidized bed jet mill according to a first exemplary embodiment of the grinding apparatus and methods according to this invention. The grinding chamber 100 has a peripheral wall 114 that is generally cylindrical in shape and that defines a central axis 151 and an empty zone or region 150 surrounding the central axis 151 in the center of the grinding chamber 100.

Three fluid sources 122 are mounted on the peripheral wall 114. A nozzle 125 is mounted at the end of each fluid source 122 that is nearest the empty zone 150. Each fluid source 122 has an inlet 124 that connects that fluid source 122 to a supply of pressurized fluid. Each inlet 124 is positioned at the end of the corresponding fluid source 122 that is outside the grinding chamber 100. In various embodiments, the fluid sources 122 are mounted symmetrically around the central axis 151, as shown in FIG. 1. However, in other embodiments, the fluid sources 122 are mounted asymmetrically. In various embodiments, the fluid is compressed air. However, in other embodiments, the fluid is an inert fluid, for example nitrogen, or any other liquid phase or gaseous phase fluid.

Each nozzle 125 defines a nozzle axis 126 extending from the nozzle 125 to the central axis 151. A first aperture plate 130 and a second aperture plate 140 are positioned perpendicular to each nozzle axis 126 between each nozzle 125 and the central axis 151. Each first aperture plate 130 has an aperture 134 generally centered on the corresponding nozzle axis 126. Each second aperture plate 140 has an aperture 144 generally centered on the corresponding nozzle axis 126. Each of the first and second aperture plates 130 and 140 operate to modify the flow of fluid around the fluid jet as will be explained in more detail below. It should also be noted that the sizes of the first and second aperture plates 130 and 140 are arbitrary and that it is not necessary for the first aperture plate 130 to be larger than the second aperture plate 140, as shown in FIG. 1.

In operation, particulate material to be ground is positioned in the grinding chamber 100 and the supply of fluid (not shown) is activated. The fluid is supplied via the inlets 124 and the fluid sources 122 to the associated nozzles 125, which generate jets of fluid directed along the associated nozzle axes 126. Particles contained within the grinding chamber 100 are entrained in the jet of fluid and accelerated towards the empty region 150 surrounding the central axis 151.

Particle to particle collisions take place within each individual entrained stream. The probability of this happening increases as the concentration of the particles in the entrained stream increases.

In the empty region 150 surrounding the central axis 151, the jets of fluid from the three nozzles 125 overlap. As a result, particles entrained in one of the jets of fluid will collide with particles entrained in one or more of the other jets of fluid. Due to the collisions, the particles will fragment, resulting in an overall reduction in the size of the particles. The reduced sized particles are then removed from the grinding chamber 100 in the usual manner.

FIG. 2 is a schematic diagram representing the flow of fluid around a fluid source and the associated aperture plates of a first exemplary embodiment of the grinding apparatus and methods according to this invention. FIG. 2 shows one of the fluid source 122, the associated nozzle 125, and the associated first and second aperture plates 130 and 140 of the apparatus of FIG. 1. As shown, the first aperture plate 130 is a laminar plate having an aperture 134. Similarly, the second aperture plate 140 is a laminar plate having an aperture 144. In the exemplary embodiment shown on FIG. 2, each nozzle 125 has a nozzle outlet having a cross-sectional area that is smaller than the cross-sectional area of the aperture 134. Similarly, the cross-sectional area of the aperture 134 is smaller than the cross-sectional area of the aperture 144.

In operation, a jet of fluid 20 produced by the nozzle 125 is directed towards the aperture 134 of the first aperture plate 130. The majority of this fluid will pass through the aperture 134. As a result, the passed portion of the jet of fluid will continue between the first aperture plate 130 and the second aperture plate 140. The passed portion 21 of the jet of fluid 20 is directed at the aperture 144 of the second aperture plate 140. The majority of the passed portion 21 of the jet of fluid 20 that passed through the aperture 134 will also pass through the aperture 144. As a result, the passed portion 22 of the jet of fluid 20 that passed through the aperture 144 continues towards the empty region 150 surrounding the central axis 151 of the grinding chamber 100.

However, the jet of fluid 20 will tend to spread away from the nozzle axis 126 after exiting the nozzle 125. Accordingly, the periphery of the jet of fluid 20 will impinge on the laminar plate 130 surrounding the aperture 134 and will be blocked by the laminar plate 130. As a result, a blocked portion 30 of the jet of fluid 20 is guided away from the axis 126 of the jet of fluid 20 in a direction parallel to the laminar plate 130. Accordingly, a high velocity stream of fluid is formed that is directed perpendicular to the jet of fluid axis 126.

As a result of this tangential stream, fluid further away from the plate 130 will be entrained to make up for this escaping flow. Thus, fluid 31 from the surrounding region within the grinding chamber 100 flows towards the jet of fluid 20. As this fluid 31 from the surrounding region includes particulate material within it, the particles are forced toward and consequently become entrained in the jet of fluid 20. This increases the particle concentration within the jet of fluid 20, thereby improving the efficiency of the grinding chamber 100.

A similar effect occurs when the passed portion 21 of this jet of fluid 20 passes through the aperture 144 of the second aperture plate 140. This time, a portion of the passed portion 21 of the jet of fluid 20 is blocked by the plate 140. The blocked portion 32 of the jet of fluid 20 is forced tangentially outward along the face of the laminar plate 140, as shown by the arrows 32. Similarly, this causes an influx of fluid 33 from the surrounding regions.

However, in this latter case, the influx of fluid from the surrounding zones is restricted due to the available width between the first aperture plate 130 and the second aperture plate 140. As a result, the stream of incoming fluid 33 has a higher velocity than the stream of incoming fluid 31. This ensures that there is deeper penetration of entrained particles into the passed portion 21 of the jet of fluid 20. This results in an even higher concentration of particles within the twice-passed portion 22 of the jet of fluid 20 that passes through the aperture 144 of the second aperture plate 140.

These particles are carried by the twice-passed portion 22 of the jet of fluid 20 to the empty region 150 surrounding the central axis 151. In this region 150, the particles will collide with particles entrained in twice-passed portion 22 of the jets of fluid 20 from the various fluid sources 120, causing fragmentation that results in the required reduced particle size.

FIG. 3 shows the fluid flow around a fluid source 122 and the associated aperture plate 130 of a second exemplary embodiment of the grinding apparatus and methods according to this invention. In this exemplary embodiment, the aperture plate 140 has been removed and replaced by a guide plate 160 that includes in a laminar plate mounted to the fluid source 122.

As with the exemplary embodiment shown in FIG. 2, in operation, the jet of fluid 20 is output from the nozzle 125 along the nozzle axis 126. As with the exemplary embodiment shown in FIG. 2, the majority of the jet of fluid 20 passes through the aperture 134 of the first aperture plate 130. However, instead of encountering a second aperture plate 140, the passed portion 21 of the jet of fluid 20 continues directly to the empty region 150 surrounding the central axis 151 of the grinding chamber 100.

As in the exemplary embodiment shown in FIG. 2, the jet of fluid 20 will tend to spread away from the nozzle axis 126 after exiting the nozzle 125. Accordingly, the periphery of the jet of fluid 20 will impinge on the laminar plate 130 surrounding the aperture 134 and will be blocked by the laminar plate 130. As a result, a blocked portion 30 of the jet of fluid 20 is guided away from the axis 126 of the jet of fluid 20 in a direction parallel to the plate 130. Accordingly, a high velocity stream of fluid is formed that is directed perpendicular to the jet of fluid axis 126. As a result of this tangential stream, fluid further away from the plate 130 will be entrained to make up for this escaping flow.

However, in contrast to the exemplary embodiment shown in FIG. 2, the guide plate 160 restricts the volume available for fluid to flow in from. Accordingly, a high velocity stream of fluid 35 is generated along the face of the laminar plate 160. This high velocity stream of fluid 35 will include entrained particles that will be forced into the center of the jet of fluid 20. This increases the concentration of the number of particles in the jet of fluid 20. Thus, by adding the guide plate 160 to cause the incoming fluid 35 to have a higher velocity, the passed portion 21 of the jet of fluid 20 incident on the empty region 150 surrounding the central axis 151 has an increased number of particles compared to an arrangement without the guide plate. This results in a higher number of collisions between particles in the empty region surrounding the central axis 151, causing an improvement in the efficiency of the grinding apparatus.

FIG. 4 is a schematic diagram showing the flow of fluid around a fluid source 122 and the associated aperture plates 130 and 140 of a third exemplary embodiment of the grinding apparatus and methods according to this invention. This is effectively a combination of the exemplary embodiments shown in FIGS. 2 and 3, as it includes both the first aperture plate 130 and the second aperture plate 140, and the guide plate 160. The overall effect of this is that the guide plate 160 and the first aperture plate 130 will act as in the exemplary embodiment of FIG. 3, while the first aperture plate 130 and the second aperture plate 140 will act as in the exemplary embodiment of FIG. 2. This results in two high velocity streams of fluid 33 and 35 in the exemplary embodiment shown on FIG. 4. By providing the two high velocity streams of fluid 33 and 35, the particle concentration in the jet of fluid 20 is further increased. This results in further improvement in the efficiency of the grinding system.

Figure 6:
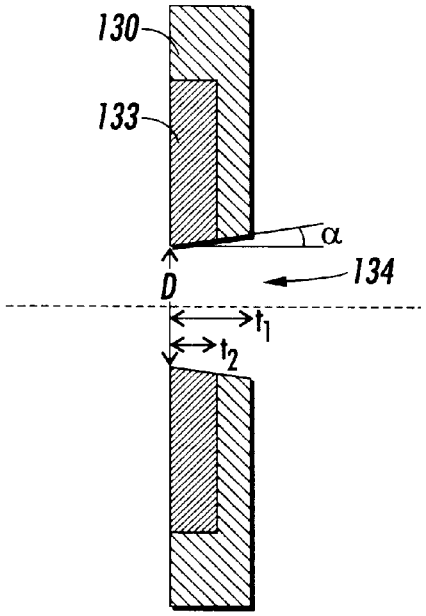
FIG. 6 is a side cross-sectional view of a second exemplary embodiment of the first and second aperture plates of FIGS. 1 to 4.

FIGS. 5 and 6 show one possible design for either the first or second aperture plates 130 and/or 140, and will be described with respect to the first aperture plate 130.

As shown in FIG. 5, the aperture plate 130 is a circular laminar plate 130 having a circular aperture 134 surrounded by a region of high impact resistance material 133. Two brackets 136 coupled to the laminar plate 130 are used to mount the aperture plate 130 within the grinding chamber.

The region of high impact resistant material 133 is designed to protect the laminar plate 130 against wear caused by collisions between the particles and the plate itself. As shown in FIG. 6, the particles will only impact the laminar plate 130 in the direction of the flow of the jet of fluid 20, the high impact resistant material 133 is only mounted on the upstream side of the laminar plate 130. The high impact resistant material 133 will generally be a strong material, such as tungsten carbide, aluminium oxide or the like, that is able to receive particle impacts without a high degree of wear, thus increasing the working life of the plate 130. An alternative to an insert of such high impact resistant material is to use a high strength coating applied to the face of the laminar plate 130 which faces the nozzle 125.

FIG. 6 is a side cross-sectional view showing the aperture 134 in greater detail. As shown in FIG. 6, the aperture 134 diverges in the direction of flow of the jet of fluid by an angle $\alpha$, which is, for example, 15 degrees. As a result, the diameter D of the aperture of the upstream face of the aperture plate 130 is smaller than the diameter of the aperture of the downstream face of the aperture plate 130. This diverging aperture 134 is created to help reduce friction between the aperture plate 130 and the jet of fluid 20 and reduces the negative influence of wear of the aperture edges on the grinding efficiency.

Friction arises because any collisions between the jet of fluid 20 and the aperture plate will result in thermal dissipation of energy causing a reduction in the velocity of the jet of fluid 20. For a good efficiency of the grinding apparatus, the jet of fluid should have as high a velocity as possible upon reaching the empty region 150 surrounding the central axis 151, the aperture 134 is designed to diverge in the direction of the flow of fluid such that the majority of impacts will occur on the front face of the laminar plate 130. As described above, impacts on the front face of the laminar plate 130 merely causes the redirection of a portion of the jet of fluid 20, as shown in FIGS. 2 to 4, with any impacts being absorbed by the annulus of high impact resistant material 133. The portion 22 of the jet of fluid 20 that passes through the aperture is then subject to little further resistance.

As shown in FIG. 2, in various exemplary embodiments of the grinding apparatus and method according to this invention, when the first or second aperture plates 130 and/or 140 are used in a grinding chamber fitted with 12.5 mm to 15.2 mm nozzles, the thickness $t_1$, of the laminar plate 130 is in the range from 5 mm to 15 mm, while the thickness $t_2$ of the impact resistant material 133 is in the range from 2 mm to 7 mm and the radius R of the laminar plate 130 is in the range from 75 mm to 450 mm. However, in other various exemplary embodiments of the grinding apparatus and methods according to this invention, one or more of these dimensions may be outside of these ranges.

The positioning of the first and second aperture plates 130 and/or 140 will depend on the aperture plate configuration being implemented, as well as the size of the grinding chamber 100. However, as shown in FIG. 2, in various embodiments of the grinding apparatus and methods according to this invention, the separation A1 between the nozzle 125 and the first aperture plate 130 is in the range from 50 mm to 100 mm, the separation A2 between the first aperture plate 130 and the second aperture plate 140 is in the range from 50 mm to 100 mm, the aperture diameter D of the first aperture 134 is in the range from 18 mm to 24 mm, the diameter D of the second aperture is in the range from 24 mm to 30 mm and the angle of divergence $\alpha$ is in the range from 4° to 20°. In other various exemplary embodiments of the grinding apparatus and methods according to this invention, one or more of these dimensions may be outside of these ranges.

Figure 7:
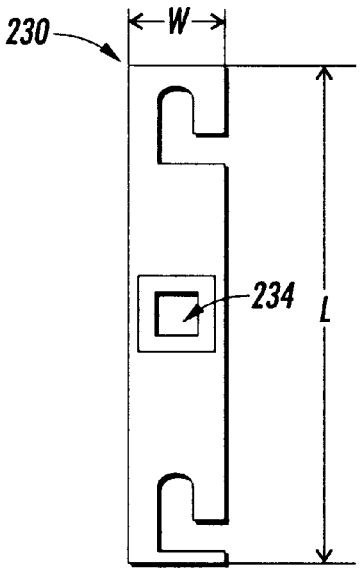
FIG. 7 is a front view of a third exemplary embodiment of the first and second aperture plates of FIGS. 1 to 4.

FIG. 7 shows a front view of a second exemplary embodiment of either the first or second aperture plates 130 and/or 140, which again will be described with respect to the first aperture plate 130. This time the aperture plate 130 is an oblong laminar plate 230 that is designed for use in geometrically restricted locations, such as within small grinding chambers. In this second aperture plate 230, the first aperture 234 is square and has a width D, and will form a diverging aperture similar to that shown in FIG. 6.

It should be appreciated that square apertures may also be used in the aperture plate 130 shown in FIG. 5 and that circular apertures may be used with the aperture plate 230 shown in FIG. 7.

In various exemplary embodiments of the grinding apparatus and methods according to this invention, the laminar plate 230 is oblong and has a length L in the range from 300 mm to 500 mm and a width W in the range from 50 mm to 200 mm. However, in other various exemplary embodiments of the grinding apparatus and method according to this invention, one or more of these dimensions may be outside of these ranges.

As a result of the first aperture plate 130 or 230 having a larger effect on the jet of fluid 20, the efficiency of the system is less sensitive to wear of the second aperture plate 140 than to wear of the first aperture plate 130 or 230. Accordingly, it is not essential that the second aperture plate 140 include the high impact resistance material, although this will further reduce the wear on the second aperture plate 140.

Figure 8:
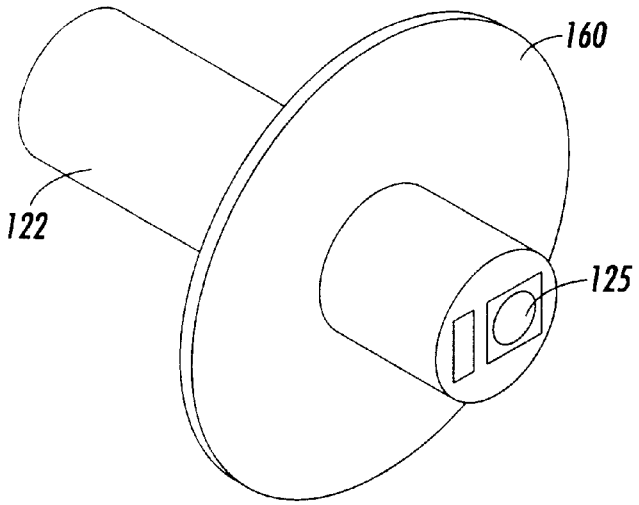
FIG. 8 is a perspective view of a first exemplary embodiment of the guide plates of FIGS. 3 and 4.
Figure 9:
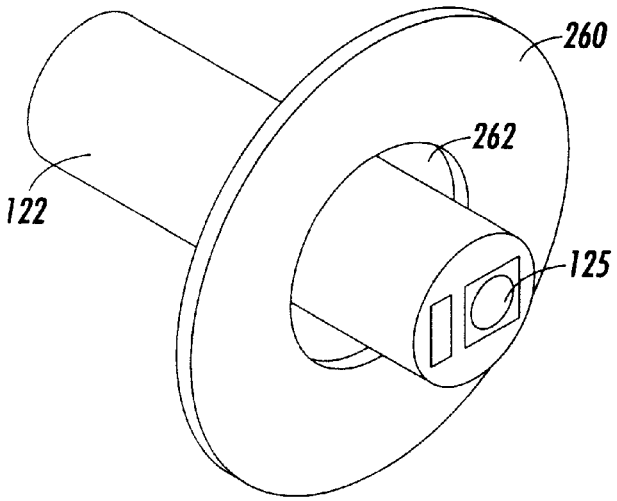
FIG. 9 is a perspective view of a second exemplary embodiment of the guide plates of FIGS. 3 and 4.

FIGS. 8–11 show various exemplary embodiments of the guide plate 160 shown in FIGS. 3 and 4. As shown in the perspective view of FIG. 8, the guide plate 160 is a laminar plate extending radially outwards from the fluid source 122. FIG. 9 is a perspective view of a second exemplary embodiment 260 of the guide plate 160. In the guide plate 260 shown in FIG. 9, an aperture 262 is located between the laminar plate 260 and the nozzle 125. The aperture 262 is designed to allow fluid flow between the nozzle 125 and the laminar plate 260 to help reduce zones adjacent the nozzle where there is little or no fluid circulation.

It is possible to use the circular laminar plates 160 or 260 for the guide plates. However where geometrical considerations mean that the use of a circular plate is not practical, oblong plates 360 such as those as shown in FIGS. 10 and 11, could also be used.

Figure 10:
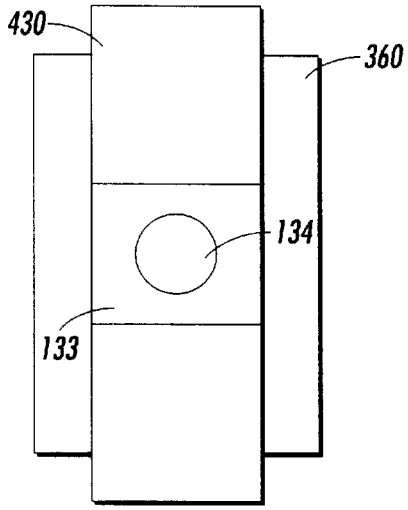
FIG. 10 is a front view of a third exemplary embodiment of the guide plates of FIGS. 3 and 4.
Figure 11:
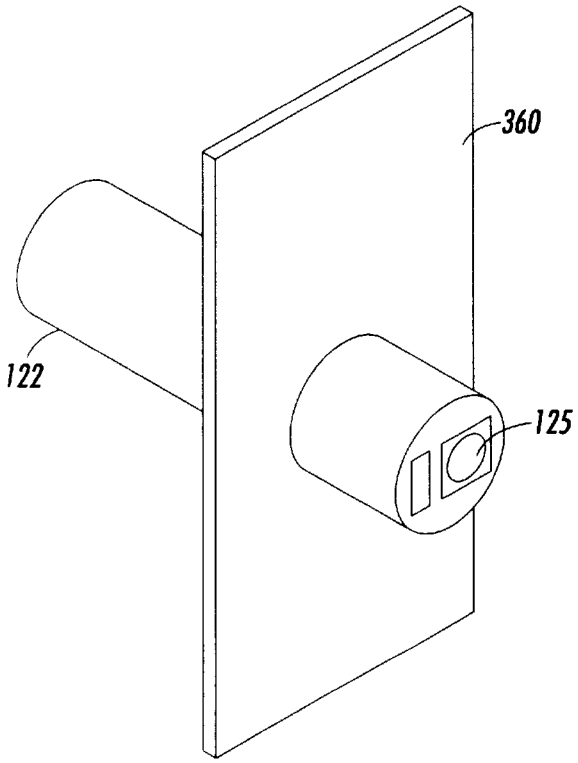
FIG. 11 is a perspective view of a fourth exemplary embodiment of the guide plates of FIGS. 3 and 4.

It should be noted that FIG. 10 shows an end view of the guide plate 360 positioned behind an aperture plate 130 that includes the impact resistant coating 133 and, surrounding the aperture 134.

Tests were performed to determine the improvements in efficiency gained with the use of the aperture plates 130–230 and 140 and the guide plates 160–360 according to this invention. In all cases, the first and second aperture plates 130 and 140 were oblong laminar plates, as shown in FIG. 7, while the guide plate 160 was circular, as shown in FIG. 8.

For the purpose of these tests, each laminar plate 330 and 340 had a width W of 75 mm, a length L of 430 mm and a thickness t of 12 mm. The aperture 334 of the first aperture plates 330 had a width D of 19 mm and divergence angle of 4.9°, while the separation A1 between the first aperture plate 330 and the nozzle 125 was 90 mm. The aperture 344 of the second aperture plate 340 had a width D of 24 mm and divergence angle of 4.9°, while the separation A2 from the first aperture plate 330 was 90 mm. All tests used 14 mm standard nozzles as the nozzles 125. The results are shown in Table 1 below.

TABLE 1

Test results of different embodiments of grinding apparatuses.

| Test | Output of Particulate Material kg/hour |
|---|---|
| No aperture plates, no guide plate | 165 |
| First and second aperture plates, no guide plate | 200 |
| First and second aperture plates, guide plate | 210 |

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An apparatus that grinds particulate material, comprising:

a grinding chamber having a central axis and a peripheral wall defining an inside of the grinding chamber;

at least two fluid sources, the fluid sources mounted on the peripheral wall about the central axis, each fluid source having a source axis and generating a stream of fluid directed along the source axis of the fluid source towards the inside of the grinding chamber;

at least two fluid flow guides, each fluid flow guide associated with one of the at least two associated fluid sources and having a first aperture located on the source axis of the associated fluid source; and, at least two guide members, each guide member associated with one of the at least two fluid sources, and having a second aperture located on the source axis of the associated fluid source, wherein each guide member co-operates with the fluid stream of the associated fluid source and the associated fluid flow guide to draw fluid towards an upstream portion of the fluid stream and to direct fluid away from a downstream portion of the fluid stream.

2. The apparatus of claim 1, wherein each fluid flow guide includes an aperture plate extending substantially perpendicularly to the associated source axis.

3. The apparatus of claim 1, wherein each fluid source includes a nozzle extending from the peripheral wall towards the central axis, and each fluid flow guide is positioned between the nozzle of the associated fluid source and the central axis.

4. The apparatus of claim 3, wherein each guide member is mounted to the nozzle of the associated fluid source and extends substantially perpendicularly to the source axis of the associated fluid source.

5. The apparatus of claim 4, further comprising at least two additional guide members, each additional guide member positioned between the fluid flow guide of the associated fluid source and the central axis and extending substantially perpendicularly to the source axis of the associated fluid source.

6. The apparatus of claim 1, wherein the first aperture of each fluid flow guide diverges away from the source axis in the direction of the fluid stream of the associated fluid source.

7. The apparatus of claim 1, wherein each guide member is positioned between the associated fluid flow guide and the central axis.

8. The apparatus of claim 7, wherein each guide member comprises an aperture plate extending substantially perpendicularly to the source axis of the associated fluid source.

9. The apparatus of claim 7, wherein the second aperture of each guide member diverges away from the source axis in the direction of the fluid stream of the associated fluid source.

10. The apparatus of claim 7, wherein each fluid source includes a nozzle extending from the peripheral wall towards the central axis, each first aperture defines a cross-sectional area of the first aperture, each second aperture defines a cross-sectional area of the second aperture, each nozzle has a cross-sectional area smaller than the cross-sectional of the first aperture of the associated fluid flow guide, and each nozzle has a cross-sectional area smaller than the cross-sectional area of the second aperture of the associated guide member.

11. The apparatus of claim 7, wherein each fluid source includes a nozzle extending from the peripheral wall towards the central axis, each first aperture defines a cross-sectional area of the first aperture, each second aperture defines a cross-sectional area of the second aperture, and the cross-sectional area of the first aperture of each fluid flow guide is smaller than the cross-sectional area of the second aperture.

12. The apparatus of claim 7, wherein each first aperture defines a cross-sectional area and each nozzle outlet has a cross-sectional area smaller than the cross-sectional area defined by the first aperture of the associated fluid flow guide.

13. The apparatus of claim 1, wherein a shape of each fluid flow guide is one of circular or rectangular.

14. The apparatus of claim 13, wherein for each fluid flow guide has a shape and the aperture of that fluid flow guide corresponds to the shape of that fluid flow guide.

15. The apparatus of claim 1, wherein each fluid flow guide has a shape, and a shape of the aperture of that fluid flow guide corresponds to the shape of that fluid flow guide.

16. The apparatus of claim 1, wherein for each first and second aperture, a shape of that aperture is one of circular or rectangular.

17. The apparatus of claim 1, wherein each fluid flow guide further comprises a reinforcing member, the reinforcing member comprising an annulus of impact resistant material surrounding a first side of the first aperture.

* * * * *